United States Patent [19]

Cataldo

[11] 4,133,172

[45] Jan. 9, 1979

[54] MODIFIED ERICSSON CYCLE ENGINE

[75] Inventor: Roy S. Cataldo, Birmingham, Mich.

[73] Assignee: General Motors Corporation, Detroit, Mich.

[21] Appl. No.: 821,576

[22] Filed: Aug. 3, 1977

[51] Int. Cl.[2] ..... F02B 41/02; F02B 53/08

[52] U.S. Cl. ..... 60/39.63; 60/39.6; 60/39.62; 123/119 C

[58] Field of Search ..... 123/122 D, 204, 119 C, 123/59 R, 59 A, 59 EC; 60/39.60, 39.62, 39.63

[56] References Cited

U.S. PATENT DOCUMENTS

| | | | |
|---|---|---|---|
| 2,160,218 | 5/1939 | Kingston et al. | 60/39.63 |
| 3,577,729 | 5/1971 | Warren | 60/39.63 |
| 3,808,818 | 5/1974 | Cataldo | 60/39.63 |

*Primary Examiner*—Ronald H. Lazarus
*Attorney, Agent, or Firm*—Arthur N. Krein

[57] ABSTRACT

A modified Ericsson cycle engine, the operating cycle of which involves sequential modes of substantially adiabatic compression, constant pressure heat addition, constant temperature expansion, heat rejection at constant volume and heat rejection at constant pressure. A preferred engine embodiment includes at least one compression cylinder discharging compressed heated air through an exhaust heat recuperator to a constant pressure heat make-up combustor wherein fuel is discharged into the air stream and ignited, at least one expander cylinder receiving the fuel-air mixture from the combustor for expansion therein, additional fuel being supplied to the gases within the expander cylinder whereby expansion will take place within the expander cylinder at constant temperature, after which the mixture is then discharged through the exhaust passages in the exhaust heat recuperator through the atmosphere.

4 Claims, 6 Drawing Figures

MODIFIED ERICSSON CYCLE ENGINE

This invention relates to engines and, in particular, to a hot gas engine and to a method of operating the same on what is herein referred to as a modified Ericsson cycle.

SUMMARY OF THE INVENTION

The present invention provides an improvement in hot gas engines and in the cycle of operation of the same whereby the engine operates on a, so-called, modified Ericsson cycle of operation. It is known from the Carnot theorem in thermodynamics that no heat engine can be more efficient than an externally reversible heat engine which is operating between the same temperature limits. Carnot chose a particularly simple non-regenerative externally reversible cycle. There is another class of ideal reversible regenerative cycles which satisfy the requirements of external reversibility and thus achieves the same theoretical efficiency. Well-known examples of this latter class are the Stirling and Ericsson cycles.

The Stirling cycle is the only cycle that has achieved a practical embodiment in terms of a working engine. However, although the Stirling engine has been the subject of considerable development, automotive application of such an engine has yet to become practical since, in order to obtain adequate efficiency and specific output, a low molecular weight fluid, such as hydrogen, is required for use as the working medium in such an engine. Furthermore, excessively high pressures in the range of 3000 psi for the working medium are required in this type engine. The Stirling cycle engine is also extremely complex requiring a combustor, pre-heater, hot heat exchanger to the working medium, regenerator, cold heat exchanger to the working medium, and roll sock seals. Practical engine embodiments of the Carnot and Ericsson cycles have not been achieved due to the extreme practical difficulties encountered in using piston and cylinder arrangements to construct such engines.

In accordance with the operating cycle of this invention, the heat addition processes of the ideal Ericsson cycle are utilized, but the heat rejection and compression processes have been changed whereby to permit construction of a practical, open cycle, fuel-air burning engine that utilizes conventional pistons and cylinders in its structure so as to be less complex mechanically. The cycle, in accordance with the invention achieves a large fraction of the classical Ericsson cycle efficiency and maintains high specific output at relatively low maximum cycle temperatures and, for this reason, it is referred to herein as a modified Ericsson cycle.

A preferred embodiment of the engine involves the use of interconnected piston-cylinder arrangements for compression and expansion of the working fluid with an exhaust heat recuperator and a combustor positioned in series between the compression and expansion cylinders, the gases discharged from each expansion cylinder flowing through the exhaust gas flow path in the exhaust heat recuperator to effect additional heating of the air delivered therethrough from each compression cylinder. Make-up heating of the working fluid is effected by injecting fuel into the combustor and igniting the fluid therein, while the main heat is supplied to the working fluid or medium in each expansion cylinder by injecting fuel therein so that expansion of the working medium occurs at constant temperature.

These and other features and advantages of the invention will be more clearly understood from the following description taken together with the accompanying drawings.

DESCRIPTION OF THE PREFERRED EMBODIMENTS

Figure 1:
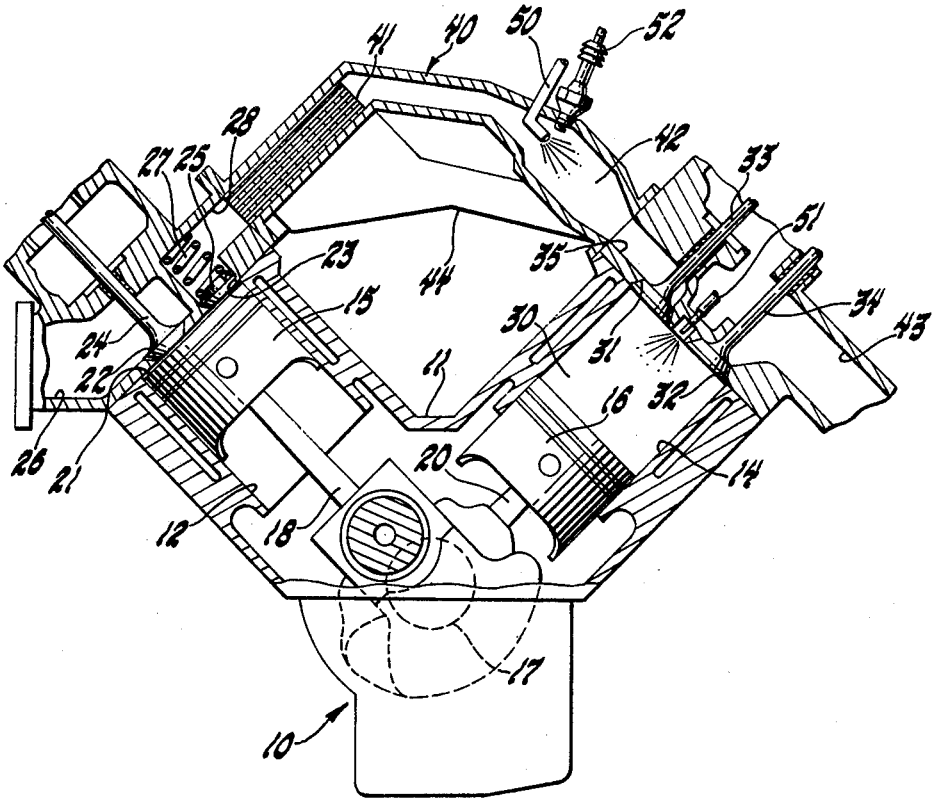
FIG. 1 is a diagrammatic cross sectional view illustrating the arrangement of a preferred embodiment of a hot gas engine in accordance with the invention.
Figure 2:
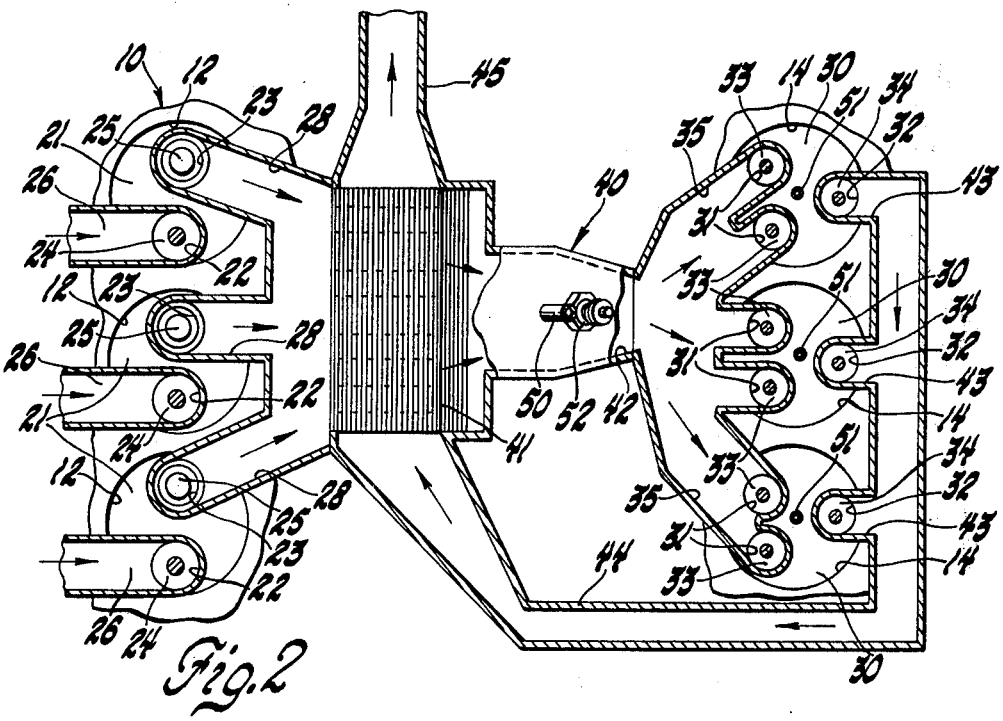
FIG. 2 is a diagrammatic top view of the engine of FIG. 1 illustrated in 6-cylinder V configuration to show the flow path of the working medium through the engine.

Referring first to FIGS. 1 and 2 of the drawings, numeral 10 generally indicates a hot gas engine constructed in accordance with the invention. Engine 10 includes an engine housing means which, in the construction shown, includes a cylinder block — head, body structure 11 having a plurality of cylinders including compression cylinders 12 and expansion cylinders 14 arranged in separate banks, each made up of a plurality of the same type of cylinders, three such cylinders being shown in each bank in FIGS. 2 and 3, thus, the construction illustrated is similar to that of a 6-cylinder engine of V configuration.

The cylinders 12 and 14 are each provided with reciprocable pistons 15 and 16, respectively, which are connected with one of the throws of the engine crankshaft 17 by means of connecting rods 18 and 20, respectively. In this manner, the pistons 16 operating in the expansion cylinders 14 provide power to the pistons 15 in the compression cylinders 12.

The compression cylinders 12 and pistons 15 therein define variable volume compression chambers 21 which are provided with inlet and outlet ports 22 and 23, respectively, controlled by inlet and outlet valves 24 and 25, respectively. In the construction illustrated, the inlet valves 24 are arranged to open outwardly in the fashion of a steam engine. Each inlet port 22 connects through a passage 26 with a source of clean air, as through a suitable induction manifold means and an air cleaner, both not shown, while each outlet port 23 is in communication with the discharge passage means 28 with the flow controlled by spring loaded discharge or outlet valves 25, each of which is pressure responsive, these valves being each normally held closed by a spring 27.

Expansion cylinders 14 and pistons 16 together define expansion chambers 30 having inlet and outlet ports 31 and 32, respectively, with flow therethrough controlled by inlet and outlet valves 33 and 34, respectively. For a purpose to be described, each cylinder 14 is preferably provided with two inlet ports 31, as seen in FIG. 2, connected to a common inlet manifold passage 35.

Intermediate the cylinder banks containing the compression cylinders 12 and expansion cylinders 14 there is provided a walled passage means 40 having a suitable heat exchange apparatus, such as an exhaust heat recuperator, generally designated 41, at one end thereof, and a portion of the walled passage means 40 defining a fixed volume combustion or combustor chamber 42 at its opposite end. The exhaust heat recuperator is positioned to be in flow receiving relationship with the discharge passage means 28 from the compression cylinders and the combustor 42 is aligned for fluid communication with the inlet manifold passage 35 to the cylinders 14. Outlet ports 32 for the expansion cylinders 14 communicate with the exhaust manifold passage 43 that is connected by a conduit 44 with the exhaust passage inlet to the exhaust heat recuperator 41, this exhaust heat recuperator at its opposite end being connected to a suitable exhaust conduit 45 for discharging exhaust gases to the atmosphere. It will be apparent that, although the heat exchange apparatus has been identified as being an exhaust heat recuperator, the actual structure of this apparatus could either take the form of a regenerator or a recuperator, as is well known in the heat exchange art, it only being necessary that the heat exchange apparatus be operative so as to transfer heat from the hot exhaust gases being discharged from the engine to the incoming charge being delivered to the combustor chamber 42.

The inlet valves 24 and 33 for the compression cylinders and expansion cylinders, respectively, and the outlet valves 34 from the expansion cylinders are cam actuated in any suitable manner well known in the art whereby these valves are opened once per crank revolution in their appropriate timed sequences. Preferably, as in the construction illustrated, the discharge or outlet valves 25 from the compression cylinder are pressure actuated so that opening of these valves is effected as soon as the pressure of the air being compressed in the associated compression cylinder reaches some predetermined value during the compression stroke of the piston 15 therein, the force of the springs 27 being selected accordingly.

Suitable fuel supply means are provided for both the combustor chamber 42 and for the expansion chamber 30 and ignition means are provided for the combustor chamber. In the construction illustrated, the fuel supply means include injection nozzles 50 and 51 for supplying fuel to the combustor chamber and to the expansion chamber, respectively, and the ignition means includes a spark plug 52, the injector nozzle 50 and spark plug 52 projecting through the wall of the walled passage means into the combustor chamber 42.

Although not shown, it should be understood that the engine further includes suitable means for operating the various fuel supply means and the ignition means in timed relation in order to carry out the intended operating cycle of the engine, as will be described hereinafter.

Operation

Figure 3:
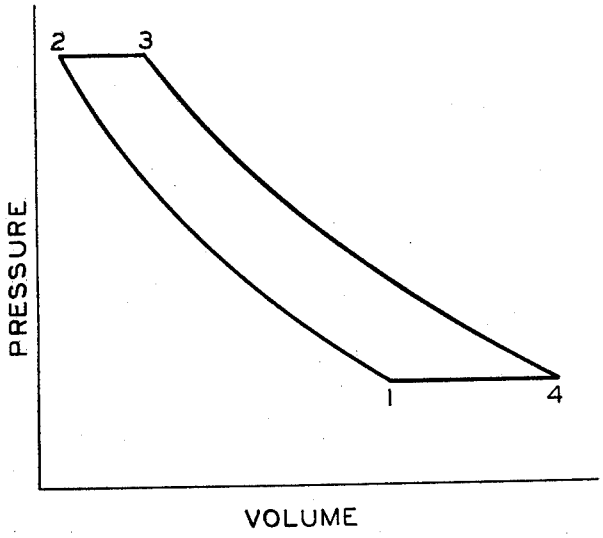
FIGS. 3 and 4 are pressure-volume and temperature-entropy curves, respectively, of the ideal Ericsson cycle; and, FIGS. 5 and 6 are pressure-volume and temperature-entropy curves, respectively, of the modified Ericsson cycle in accordance with the invention.
Figure 4:
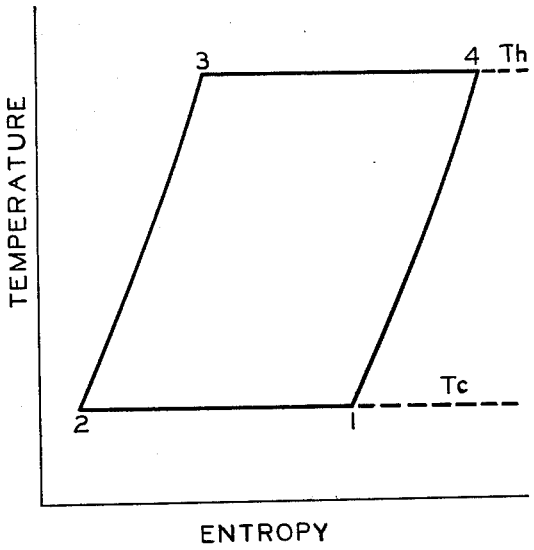

Before discussing the operation of the engine in accordance with the invention, a brief review of the ideal Ericsson cycle and of the, so-called, modified Ericsson cycle of the invention is deemed appropriate. The ideal Ericsson pressure-volume and temperature-entropy diagrams are shown in FIGS. 3 and 4, respectively, for equal maximum and minimum temperatures (Th) and (Tc) and maximum and minimum pressures ($P_3$) and ($P_1$). The Th and Tc lines in these figures represent constant temperature or isothermal heat addition and heat rejection, respectively.

As is well known, the ideal Ericsson cycle is comprised of the processes linking state points 1–2–3–4–1 and has two heat addition and two heat rejection processes. In the Ericsson cycle, the second heat process between state points 2–3 occurs at constant pressure as does the second heat rejection process which occurs between state points 4–1. Since the second heat addition and heat rejection phase occurs between the same temperature limits, all of the heat required for the second heat process 2–3 may be supplied by the second heat rejection process 4–1 and thus the Ericsson cycle has the same ideal efficiency as the Carnot cycle for the same temperature limits and, accordingly, is theoretically an ideal regenerator cycle. Unfortunately, the diagrams in FIGS. 3 and 4 represent the classic, ideal Ericsson cycle which, as far as is known, has not been accomplished in any working engine, much less in a practical embodiment of such an engine.

Figure 5:
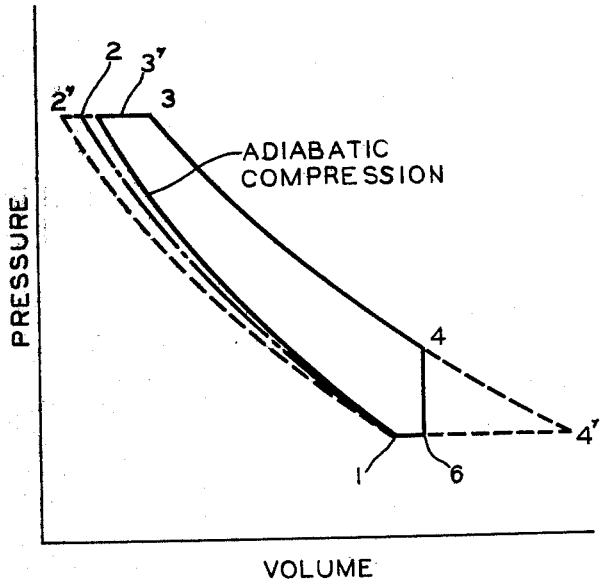
Figure 6:
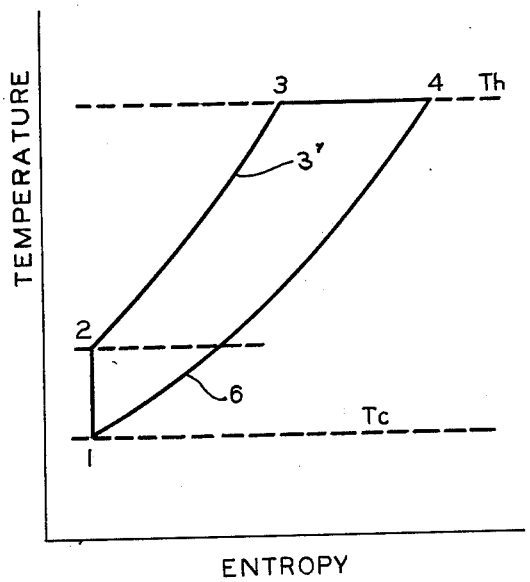

The engine operation cycle, in accordance with the invention, also has two heat addition processes as in the above described Ericsson cycle, the pressure-volume and temperature-entropy diagrams for the cycle of the invention being shown in FIGS. 5 and 6, respectively. These two heat addition processes in the subject cycle are the constant pressure heat addition between state points 2 and 3, with reference to FIGS. 5 and 6, and the constant temperature heat addition between state points 3 and 4. The cycle in accordance with the invention differs from the classic Ericsson cycle in the heat rejection process, that is, in the subject cycle, heat is rejected at constant volume between state points 4–6, FIG. 5, and at constant pressure between state points 6–1. No heat is rejected between state points 1–2, FIG. 5, this process being substantially adiabatic compression.

An examination of FIG. 6 will show that, unlike the Ericsson cycle, all of the heat required in the subject cycle for the constant pressure heat processes 2–3 is not supplied by regeneration of the two heat rejection processes since only the heat rejected above state point 2 can be recovered. In accordance with the invention, regenerated heat is obtained between state points 2 and 3' and additional heat required between state points 3'–3 is supplied from an external source at constant pressure. This is accomplished by the use of the injection nozzle 50 of the fuel supply means for supplying fuel to the combustor chamber which is then ignited by the spark plug 52 to effect burning of this fuel. It will be seen from a comparison of the temperature-entropy diagrams of FIGS. 4 and 6, that the thermal efficiency of the operating cycle in accordance with the invention is somewhat reduced from the classic Ericsson cycle for the same temperature limits.

The specific output of the subject cycle, as measured by the cycle mean effective pressure, is relatively high for relatively low maximum pressures and temperatures at state point 3. This feature of the subject cycle is important since the temperature at state point 3 would be maintained continuously during maximum engine load operation and thus this temperature could impose thermal stress problems if the temperature is relatively high. However, for example, with a maximum temperature of 2500° F. at state point 3, the engine would produce a brake mean effective pressure of approximately 102.8 psi for maximum pressure at state point 3 of only about 503 psi. Obviously, lower mean effective pressures, indicative of lighter engine loads, would be achieved at lower temperatures and pressures.

This relatively high mean effective pressure for low maximum temperatures is the result of the greater useful work of the subject cycle due to the constant temperature heat addition process between state points 3–4 and the cutting off of the "Toe" of the work loop, that is, the area outlined by the state points 6–4–4'–6, of FIG. 5. This reduces the volume change of the subject cycle between state points 6–2, and thus increases the mean effective pressure.

It is well known that actual piston compressors follow neither an adiabatic or isothermal compression line, but would have sufficient heat loss during compression so as to provide a post compression state shown graphically in FIG. 5 as occuring somewhere between the state points 2–2', true adiabatic compression being shown by the solid curve line in that figure. Thus, in the operation of the subject engine, the actual compressor temperatures at state point 2 would increase the regenerated temperature at state point 3' to a temperature $T_3'$ and would thus reduce the amount of heat which must be supplied externally at constant pressure from state points 3'–3.

In operation, the various pistons, cam actuated inlet and exhaust valves and the fuel injection means together with the ignition system are operated in timed relation upon rotation of the crankshaft 17. Upon downward movement of each piston 15 in a compression cylinder 12, the inlet valve 24 associated with that cylinder opens, permitting a charge of air to be drawn into the compression chamber 21 through the inlet passage 26 associated with that cylinder. Valve 24 then closes and the piston 15 moves upwardly, compressing the air charge until the piston reaches a position near top dead center. During the compression stroke of the piston 15, the associated discharge or outlet valve 25, which is pressure actuated, will open at a predetermined pressure to discharge air out through discharge passage 28 to the air passage in the exhaust heat recuperator 41. During compression, the volume of air admitted into a compression cylinder is substantially adiabatically heated from state point 1 to state point 2 temperature. The compressed air output from the compressor cylinder is then heated from temperature $T_2$ to a temperature $T_3'$ during its passage through the exhaust heat recuperator 41 by utilizing the exhaust heat from the exhaust gases discharged from the expander cylinders 14, this heat exchange being effected within the recuperator.

From the exhaust heat recuperator 41, the thus heated air flows into the combustor chamber 42. Since additional heat must be supplied to this air to raise its temperature from $T_3'$ to $T_3$ at constant pressure, a relatively small constant pressure burner is provided by the combustion chamber and the elements associated therewith to effect this heating. The overall air/fuel ratios required in the constant pressure burner or combustor chamber 42 are extremely lean being approximately 90.5:1 at full load and appropriately leaner at part load conditions.

At state point 3, FIGS. 5 and 6, the maximum cycle temperatures have been achieved and the slightly vitiated charge is inducted into an expander cylinder 14, preferably from top dead center to approximately 30° after top center (ATC). As shown in the construction illustrated, two intake valves 33 are preferably used with each expansion cylinder 14 to maintain low expander inlet valve pressure drop during induction of the heated, slightly vitiated, charge into the expander cylinder.

Each of the expander cylinders 14 is preferably fitted with direct cylinder fuel injectors 51 which are operated so as to inject fuel during expansion of the charge within the expander chambers sufficient to maintain constant temperature within the cylinder. Thus, each of the expander cylinders 14 is operated so as to provide a relatively slow heat release sufficient to provide the pressure difference between isothermal and adiabatic expansion. The charge of working medium within each expander cylinder is then expanded during downward motion of the pistons 16 in the expansion cylinders, with the admission of the charge being cut off by closing of the inlet valves 33 at a suitable point in the expansion stroke. When each piston 16 reaches its downward position, the respective outlet or exhaust valve 34 is opened and the piston moves upwardly forcing out the expanded combustion products. The expansion of the charge in the expansion cylinders 14 results in the development of useful work which is transmitted to the engine crankshaft in conventional fashion, some of this work being absorbed in the operation of the combustion pistons 15, as well as other engine components.

Exhaust gases discharged from the expansion cylinder 14 flow through the passages 43 and conduit 44 to the exhaust inlet of the exhaust heat recuperator 41 to flow through the exhaust passage in the recuperator for discharge out through the exhaust conduit 45. During flow of the exhaust gases through the recuperator, these gases will be in suitable thermal heat exchange relationship to the incoming charge of compressed air flowing through the air passage portion of the recuperator whereby to provide heating of this charge of air.

In the above operation, the charge volume of working medium is expanded in the expander cylinders 14 between state points 3–4; between state points 4–6 during blow-down, when the exhaust valves 34 are opened, due to action of the expander cylinders on their upward stroke; and, then between state points 6–1 as the exhaust gases flow through the recuperator out to the atmosphere.

It will be obvious that the high rates of pressure rise are not required at any time during the subject cycle of engine operation. Maximum pressures will be relatively low within the subject engine and, accordingly, a lighter mechanical structure than presently used for Otto cycle engines can be utilized. The subject cycle of engine operation, as thus disclosed, might be termed a non-ideal regenerative cycle but, since it is somewhat similar to the classic ideal Ericsson cycle, but modified relative thereto, for purposes of this disclosure, it is appropriately referred to as a modified Ericsson cycle.

Load control of the subject engine is achieved by means of air/fuel ratio control which indirectly controls the mean effective pressure of the engine, means for effecting such air/fuel ratio control being well known in the engine art and, accordingly, need not be described in detail herein. It should be noted that air is always available, so air can be used to effect atomization of fuel flowing from the fuel injectors 50, 51, in a well known manner. No throttle is required to effect operation of the subject engine and, thus, throttle pumping losses are eliminated as in a diesel engine.

It will be apparent that the maximum cycle temperature, that is, the temperature $T_3$ at state point 3, determines the compression ratio of the engine. Of course, as is well known, other variables which effect operating compression ratio are the volumetric efficiency of the compressor and the valve cut off ratio of the expander cylinders. In a particular embodiment, the compression ratio of the subject engine would vary from a maximum of 14.3:1 at full load (BMEP = 102.76 psi) to 8.51:1 at part load (BMEP = 27.75 psi). The engine shown in FIGS. 1 and 2, operating on the cycle of the subject invention, is capable of operation at a large reduction in fuel consumption as compared to conventional engines. At full load, the brake specific fuel consumption (BSFC) would be approximately twenty percent lower than today's best large diesel engines and, at part load, it would be approximately thirty-two percent better than today's 8:1 compression ratio Otto cycle engines. The relatively low maximum operating pressures of the subject engine would permit it to have a lighter engine block and head construction as compared to today's low compression ratio engines. In addition, during operation, the subject engine would be extremely quiet since high rates of pressure rise are not required in its operation. It will be apparent that flame speed effects would be negligible since very low rates of heat release are required during its operation. This would also result in relatively low fuel injection pressures for the expander fuel injectors.

Due to the extremely lean overall air/fuel ratios during engine operation, even at full load, the constant pressure in the combustor chamber at a part load will produce very low concentrations of $NO_x$, HC and CO. The small percentage of burned fuel in the constant pressure combustor chamber will act as a small percentage of residual in the expander cylinders. Accordingly, the small residual along with the extremely lean air/fuel ratios in the expander cylinders would be operative to prevent any appreciable concentration of $NO_x$ to form. HC and CO emissions should also be low for the same reason. Furthermore, it should be noted that the recuperator will act as an extremely efficient after reactor for the exhaust gases, since reactor reaction rate increases greatly with pressure and temperature. It will also be apparent that the subject engine has multi-fuel capability due to the lean air/fuel ratio requirements throughout the engine and the low heat release rates during the operating cycle of the subject engine. Because of these characteristics, the subject engine is capable of burning low octane gasoline or diesel fuel, if desired, since it effectively operates on an open fuel-air burning cycle.

It will be apparent to those skilled in the art that a number of modifications can be made to both the engine structure shown and the operating cycle disclosed without departing from the scope of the subject invention. For example, although the walled passage means 40 is illustrated and described as including a heat exchanger, in the form of an exhaust heat recuperator 41, and a fixed volume combustor chamber 42, the heat exchanger and combustor chamber could readily be formed as separate elements suitably secured together to operate in the manner described and, of course, the heat exchanger could be of any known type, as previously described. It will also be apparent that, if desired, further improvement in fuel economy is feasible with the subject engine by increasing cooling of the compression cylinders during the compression process, thereby forcing the cycle of the invention closer to the classic Ericsson cycle.

What is claimed is:

1. An engine adapted to operate on a modified Ericsson cycle, said engine including an engine block having a first cylinder bank and a second cylinder bank angularly disposed relative to said first cylinder bank and mounting a crankshaft, at least one compressor cylinder in said first cylinder bank and at least one expander cylinder in said second cylinder bank, a compressor piston reciprocally disposed in said compressor cylinder to define therewith a variable volume compression chamber and an expander piston reciprocally disposed in said expander cylinder to define therewith a variable volume expansion chamber, said compressor piston and said expander piston each being operatively connected to said crankshaft, said compressor cylinder and said expander cylinder each having inlet passages and outlet passages and valves positioned therein for controlling the ingress and egress of fluid therethrough, said inlet passage of said compressor cylinder being operatively connected to a source of air, an exhaust heat recuperator and a combustor having a constant volume combustion chamber therein connected in series with said combustion chamber being in fluid communication with said inlet passage of said expander cylinder, said exhaust heat recuperator having first passage means connected at one end to the outlet passage of said compressor cylinder and at its other end in fluid communication with said combustion chamber and a second passage means having one end connected to the outlet passage of said expander cylinder and its other end opening for communication to the atmosphere, said second passage means being in heat exchange relationship with said first passage means, ignition means and a first fuel supply means operatively associated with said combustion chamber and a second fuel supply means operatively associated with said expander cylinder, said pistons, said valves, said first fuel supply means, said second fuel supply means and said ignition means being operatively related through said crankshaft to cause said engine to perform an operating cycle including the steps of:

a. admission of air to the compressor cylinder during the intake stroke of said compressor piston,
b. substantial adiabatic compression of the air in said compressor cylinder during the compression stroke of said compressor piston,
c. transfer of the compressed air through said outlet passage of said compressor cylinder to said first passage means in said exhaust heat recuperator so that the compressed air is then heated by exhaust gases flowing through said second passage means of said exhaust heat recuperator,
d. transfer of the compressed and heated air to said combustion chamber,
e. admission of sufficient fuel through said first fuel supply means with ignition and burning thereof so that heat is added at constant pressure to the fluid in said combustion chamber,
f. transfer of the compressed and heated gases from said combustion chamber to said expander cylinder during opening of said valve controlling flow through said inlet passage to said expander cylinder,
g. admission of additional fuel by said second fuel supply means and combustion thereof during the expansion stroke of said expander piston in said expansion cylinder at constant temperature with a resultant output of work to said crankshaft, and
h. exhaust of the spent gases from said expansion cylinder through said second passage means of said exhaust heat recuperator to the atmosphere.

2. A hot gas engine including an engine block-head body providing at least one compressor cylinder and one expander cylinder therein, a crankshaft mounted in said engine block-head body, a compressor piston reciprocally disposed in said compressor cylinder to define therewith a variable volume compression chamber, an expander piston reciprocally disposed in said expander cylinder to define therewith a variable volume expansion chamber, said compressor piston and said expander piston each being operatively connected to said crankshaft, a first inlet passage and a first discharge passage each opening at one end into said compressor cylinder, valve means operatively associated with said first inlet passage and said first discharge passage for controlling the flow therethrough, said first inlet passage to said compressor cylinder being operatively connectable to a source of air, a second inlet passage and a second discharge passage each opening at one end into said expansion cylinder, second valve means operatively associated with said second inlet passage and said second discharge passage for controlling the flow therethrough, an exhaust heat recuperator having a first passage means with an inlet and an outlet and a second passage means with an inlet and an outlet in thermal heat exchange relationship to eacb other, said first discharge passage from said compressor cylinder being connected to said inlet of said first passage means, means providing a fixed volume combustion chamber operatively connected at one end to the outlet of said first passage means and connected at its opposite end to said second inlet passage, fuel injection means and spark ignition means positioned to extend into said combustion chamber for supplying fuel to said combustion chamber and effecting ignition of same, second fuel injection means operatively connected to said expander cylinder for supplying said expander cylinder with fuel, said second discharge passage from said expander cylinder being connected to the inlet of said second passage means, the outlet of said second passage means being connectable to be in flow communication with the atmosphere.

3. A hot gas engine including an engine housing means having spaced apart compressor cylinders and expander cylinders therein, a crankshaft mounted in said engine housing means, a compressor piston reciprocally disposed in each said compressor cylinder to define therewith a variable volume compression chamber, an expander piston reciprocally disposed in each said expander cylinder to define therewith a variable volume expansion chamber, said compressor pistons and said expander pistons each being operatively connected to said crankshaft, each said compressor cylinder having a valve controlled air inlet passage and a first valve controlled discharge passage in communication therewith, each said expander cylinder having a valve controlled inlet passage and a second valve controlled discharge passage in communication therewith, an exhaust heat recuperator having a first passage means with an inlet and an outlet and a second passage means with an inlet and an outlet positioned in thermal heat exchange relationship to each other, said first valve controlled discharge passage from said compressor cylinder being operatively connected to said inlet of said first passage means, means providing a fixed volume combustion chamber operatively connected at one end to the outlet of said first passage means and operatively connected at its opposite end to said valve controlled inlet passage, fuel injection means and spark ignition means operatively connected to said combustion chamber for supplying fuel to said combustion chamber and for effecting ignition of same, each said expander cylinder having a second fuel injection means operatively connected thereto for supplying each said expander cylinder with fuel, said second discharge passage from each said expander cylinder being operatively connected to the inlet of said second passage means, the outlet of said second passage means being connectable to be in flow communication with the atmosphere.

4. A method of engine operation for an engine including engine body means having at least on compressor cylinder and one expander cylinder therein and a crankshaft mounted for rotation therein, a compressor piston reciprocally disposed in said compressor cylinder to define therewith a variable volume compression chamber, an expander piston reciprocally disposed in said expander cylinder to define therewith a variable volume expansion chamber, said compressor piston and said expander piston each being operatively connected to said crankshaft, an exhaust heat recuperator having an air passage means and an exhaust passage means therethrough, and a fixed volume combustion chamber means connected in series, said compression cylinder having a valve controlled inlet operatively connectable to a source of air and an exhaust passage connecting to said air passage means of said exhaust heat recuperator, said expander cylinder having a valve controlled inlet connected to said combustion chamber means and an exhaust discharge passage connectable to said exhaust passage means of said exhaust heat recuperator, said method of engine operation including the steps of:

a. admitting air to said compressor cylinder during the intake stroke of said compresssor piston,
b. compressing said air substantially adiabatically in said compressor cylinder during the compression stroke of said compressor piston,
c. transferring the compressed air delivered from the compressor cylinder to said exhaust heat recuperator whereby the air is heated by exhaust gas flowing through said exhaust heat recuperator,
d. transferring the compressed and heated air to said combustion chamber,
e. adding fuel to the air in said combustion chamber and ignition of the fuel to effect burning of the fuel at constant pressure in the combustion chamber to provide a heated working medium,
f. transferring the compressed and heated working medium from the combustion chamber to said expander cylinder,
g. adding additional fuel to the working medium in the expander cylinder whereby during the expansion stroke of said expander piston the working medium is maintained at constant temperature with a resultant output of work to the crankshaft and,
h. discharging the working medium from the expansion chamber through said exhaust passage means of said exhaust heat recuperator in heat exchange relationship to the compressed air flowing therethrough and then discharging the working medium to the atmosphere.

* * * * *